US005520555A

United States Patent [19]

Taylor

[11] Patent Number: 5,520,555

[45] Date of Patent: May 28, 1996

[54] ELECTRICAL COUPLING

[75] Inventor: John C. Taylor, Balladoole, Isle of Man

[73] Assignee: Strix Limited, United Kingdom

[21] Appl. No.: 220,524

[22] Filed: Mar. 31, 1994

[30] Foreign Application Priority Data

Apr. 1, 1993 [GB] United Kingdom ..... 9306881

[51] Int. Cl.[6] ..... H01R 13/64

[52] U.S. Cl. ..... 439/680; 439/685; 439/217

[58] Field of Search ..... 439/92, 105, 106, 439/107, 170, 216, 217, 218, 502, 505, 677, 680, 682, 685

[56] References Cited

U.S. PATENT DOCUMENTS

| | | | |
|---|---|---|---|
| 4,047,781 | 9/1977 | Denigris et al | 439/218 X |
| 4,518,212 | 5/1985 | Rumble | 439/218 X |
| 4,609,244 | 9/1986 | Buscher et al. | 439/217 |
| 4,632,121 | 12/1986 | Johnson et al. | 439/502 X |
| 4,775,802 | 10/1988 | Dods | 439/502 X |
| 5,254,018 | 10/1993 | Sawada | 439/680 |
| 5,292,259 | 3/1994 | Sheldrake et al. | 439/353 |

*Primary Examiner*—Khiem Nguyen
*Attorney, Agent, or Firm*—Bacon & Thomas

[57] ABSTRACT

An electrical coupling for use in an appliance such as a kettle or hot water jug comprises an inlet in the appliance having a standard pin configuration, but a non-standard profile to prevent a standard connector being inserted therein. A connector for engagement therewith has a standard socket configuration but a non-standard shape to prevent it being inserted in a standard inlet. The polarity of the line and neutral terminals within the connector is reversed with respect to the standard configuration.

23 Claims, 3 Drawing Sheets

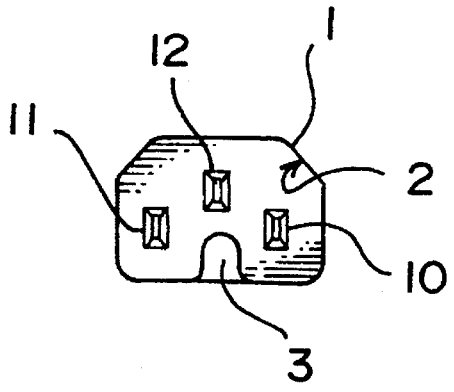
FIG. 1a
(PRIOR ART)
FIG. 1b
(PRIOR ART)
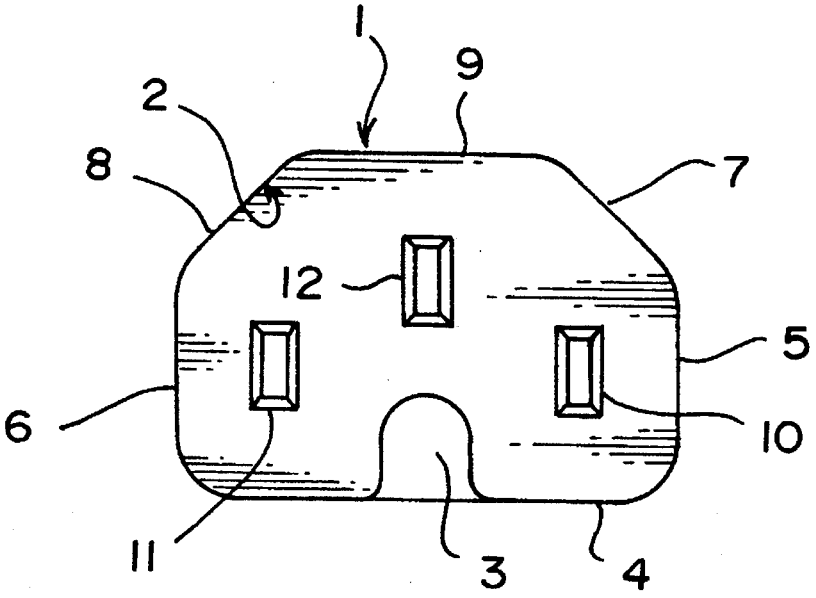

ELECTRICAL COUPLING

The present invention relates to electrical couplings and in particular to electrical couplings for domestic appliances such as kettles and hot water jugs. Such appliances comprise an appliance inlet housing a number of electrical contact pins in a predetermined configuration, power being supplied to the pins by a connector inserted into the inlet, and having a number of pin-receiving receptacles or sockets, arranged in the same configuration as the pins.

The configurations of the appliance inlet and the connector are determined in accordance with national and international standards, depending on the type of appliance, the current to be handled by the coupling and the maximum temperature of the inlet pins.

In the case of electric kettles and jugs, one coupling commonly used up to now has traditionally been one which complies with standard No. 320 of the International Electrical Commission Sheets C15 and C16 (320 IEC 1981), the content of which is incorporated herein by reference. Such a coupling will hereafter be termed "a coupling of the type described". This relates to earthed electrical equipment rated at 10A, 250 V in which the temperature of the pins does not exceed 120° C.

FIG. 1*a* and 1*b* show views from sheet C16 of 320 IEC 1981, showing the traditional form of appliance inlet and pin configuration in accordance with this standard. Henceforth these will be referred to as "a standard appliance inlet of the kind described" and "a pin configuration of the kind described". In particular a pin configuration of the kind described comprises three rectangular section pins each preferably having a cross-section of 4 mm±0.1 by 2 mm±0.05. The pins are arranged in a symmetrical triangular configuration about the centre line of the earth pin. The centre lines of the line and neutral pins are spaced apart by 14 mm±0.2, and the centre line of the earth pin is displaced from the common centre line of the other two pins by 4 mm±0.2.

A standard appliance inlet of the kind described is generally rectangular but with two chamfered corners. A straight base wall merges at each end with straight side wall portions through a radius of 3 mm maximum. The side walls, which are 24 $mm_{-0}^{+0.5}$ apart, merge with respective inwardly sloping chamfer portions through a radius of 2 mm maximum, the angle between the chamfered portions and the side wall portions being $45°_{-3}^{+0}$. The points of intersection of extended lines from the chamfer portions and side walls lies at a position 3 $mm_{-0}^{+0.5}$ above the horizontal centre line of the inlet. The chamfer portions merge through a radius of 2 mm maximum at their other end into a top wall spaced 16 $mm_{-0}^{+0.5}$ from the base wall. A key portion extends from the base wall to a height 3.3 $mm_{-0}^{+0.3}$ below the centre of the inlet. The key is of a width 4.5 $mm_{-0.3}^{+0}$ and has a radiused upper portion.

FIGS. 2*a* and 2*b* show views from sheet C15 of 320 IEC 1981, showing the connector and socket engagement face configuration in accordance with this standard. Henceforth these precise forms as illustrated will be referred to as "a standard connector of the kind described" and "a socket configuration of the kind described". In particular a socket configuration of the kind described is one in which the sockets are arranged symmetrically about the earth connector in a triangular configuration, each socket preferbly having a rectangular cross-sectional area of 5 $mm_{-0}^{+0.5}$ by 2.5 $mm_{-0}^{+0.3}$. Line and neutral sockets share a common centre line and are arranged apart by 14 mm±0.2 mm, the earth socket being arranged at a distance of 4 mm±0.2 mm from the common centre line of the two other sockets.

A standard connector of the kind described has a cross-section adapted to match the standard appliance inlet of the kind described. It is generally rectangular but has two chamfered corners. A straight base surface blends through a radius of 3.5 mm minimum with side surfaces spaced apart by 23 $mm_{-0.5}^{+0}$ which in turn blend with chamfered surfaces through a radius of 3 mm minimum. The angle between the chamfered portions and the side surface portions is $45°_{-0}^{+3}$, and lines extended from the chamfered surfaces and the side wall surfaces intersect at a point 2.5 $mm_{-0.5}^{+0}$ from the horizontal centre line of the socket. The chamfered surfaces blend at their other end, with an upper surface spaced 15.8 $mm_{-0.5}^{+0}$ from the base surface. A keyway is formed in the base surface, having a width of 5 $mm_{-0}^{+0.3}$ and having a radiused upper portion, the top of the radiused portion reaching to a point 3 $mm_{-0.3}^{+0}$ from the centre line of the socket.

In a connector of the kind described, in accordance with 320 IEC 1981, an earth connection is provided in the central, upper socket (as illustrated), a line connection in the lower right hand socket and a neutral connection in the lower left hand socket. In use, the earth pin may be uppermost or the entire coupling may be inverted so that the earth pin is lowermost.

Commonly in kettles and hot water jugs, the pins of the appliance are formed as part of an integrated electrical control mounted in the appliance. This control normally comprises a boiling sensor, for example a bimetallic actuator, which opens a set of switch contacts within the control when water in the appliance boils. This switch is arranged so that it may be reset manually by a user when it is desired to re-boil water in the appliance. The control also normally comprises a so-called "dry boil" protector which opens a set of switch contacts within the control when the element of the appliance overheats when, for example, the appliance boils dry or is switched on with no water in it.

Up to now, the switch operated by the boiling sensor has traditionally been arranged in the neutral side of the supply to the heating element of the appliance. However, in accordance with new safety regulations in the United States upon the introduction of a polarised power supply, such switches are regarded as on/off switches and must henceforth be arranged in the line side of the supply to the appliance element. Thus the traditional controls used elsewhere in the world will now have that switch in the wrong side of the electrical supply to the element.

To overcome this problem, it would be possible to re-design the control to place the on/off switch in the other side of the supply to the element whilst using a coupling of the kind described to connect the appliance to a power supply. However, this would be expensive and would mean that such controls would not be usable elsewhere in the world, where the polarity requirement of the switch was different.

To overcome this problem therefore, the present invention proposes reversing the polarity of the line and neutral connections in the connector of an electrical coupling of the kind described, so that what was the line connection in the connector of the coupling becomes the neutral connection and vice versa. This will avoid the need for expensive re-design of the control which can be used without modification in both the United States and elsewhere, and which leaves the configuration of the pins and sockets unchanged.

However, since the polarity of the connections of a connector in accordance with the invention has been reversed with respect to those of a connector of the kind described, a user should not be able inadvertently to insert a standard connector of the kind described in an appliance inlet in accordance with the invention. Accordingly, means are provided in the inlet which prevents the insertion of a standard connector of the kind described into an inlet of a coupling in accordance with the invention. Preferably the means are provided by a portion of the profile of the inlet. Most preferably, a key portion of the inlet has a dimension larger than a corresponding keyway portion of a standard connector of the kind described, whereby the keyway portion may not engage with the key portion. However, the key portion matches a keyway of a connector in accordance with the invention.

Similarly a user must not be able to insert a connector in accordance with the invention into a standard inlet of the kind described, since in countries where the boiling switch is required to be in the neutral side of th supply, if connector in accordance with the invention were to be used, the appliance would not meet safety requirements. Accordingly, means are provided to prevent a connector in accordance with the invention being inserted in a standard inlet of the kind described. Preferably such means are provided by the external profile of the connector extending outside that of a standard inlet of the kind described. Thus a dimension of the connector in accordance with the invention, for example a diagonal dimension, may be greater than a corresponding dimension in a standard inlet of the kind described. However, it will match an inlet in accordance with the invention.

Thus, in one broad aspect the invention provides an electrical coupling in or for an electrical appliance such as a kettle or hot water jug comprising: an inlet provided or adapted or be provided on said appliance and a connector provided or adapted to be provided on a power lead for mating engagement with said inlet, said inlet having pins arranged in a pin configuration of the kind described, and said connector having sockets arranged in a socket configuration of the kind described, wherein:

a) the polarity of electrical connections arranged within the sockets of the connector is reversed with respect to those in a standard connector of the kind described;

b) first means are provided to prevent said connector being inserted into a standard inlet of the kind described; and c) second means are provided to prevent a standard connector of the kind described being inserted into said inlet.

From a second aspect, the invention provides an electrical coupling having an inlet and a connector for engagement therewith, said inlet comprising three pins constituting an earth pin, a neutral pin and a line pin, said pins each having a longitudinal centre line and a transverse centre line, said pins being arranged in a triangular configuration symmetrically about the longitudinal centre line of the earth pin, the transverse centre lines of the line and neutral pins being substantially aligned, with the pins spaced apart by 14 mm±0.2 transverse centre line of the earth pin being displaced from the common centre line of the line and neutral pins by 4 mm±0.2, and said connector having three sockets constituting earth, line and neutral sockets for receiving the earth, line and neutral pins provided in the inlet, each said socket and having longitudinal and transverse centre lines, said socket being arranged symmetrically in a triangular configuration about the longitudinal centre line of the earth connector, the line and neutral sockets sharing substantially a common transverse centre line and spaced apart by 14 mm±0.2 and the transverse centre line of the earth socket being spaced 4 mm±0.2 mm therefrom, said connector having a shape which is adapted to be received in said inlet to make electrical connection therewith, said inlet having first means such that a further connector having the same socket configuration as aforesaid, measuring 23 $mm_{+0}^{-0.5}$ by 15.8 $mm_{+0}^{-0.5}$, having chamfered corners at one side thereof extending at approximately 45° to the adjacent side walls to a distance of 25 $mm_{-0.5}^{+0}$ from the centre line of the further connector and having a keyway portion symmetrically arranged on the side wall opposite the chamfers, said keyway portion being 5 $mm_{-0}^{+0.3}$ wide, extending to a depth of 3.3 $mm_{-0}^{+0.3}$ from the centre line of the further connector, and being radiused at its bottom end, cannot be received therein, said electrical connector further having second means to prevent it being inserted in a further inlet having the same pin configuration as aforesaid, measuring 24 $mm_{-0}^{+0.5}$ by 16 $mm_{-0}^{+0.5}$ having chamfered corners at an angle of $15°_{+3}^{-0}$ to the shorter side walls and terminating 3 $mm_{-0}^{+0.5}$ from the centre line of the further inlet and a key arranged symmetrically on the wall opposite the chamfers having a width of 1.5 $mm_{-0.3}^{+0}$, extending to a depth of 3.3 $mm_{-0}^{+0.3}$ from the centre line of the further socket and radiused at its bottom end.

From a third aspect, the invention provides an inlet in or for an electrical appliance comprising three rectangular section pins constituting an earth pin, a neutral pin and a line pin, each pin having a longitudinal centre line and transverse centre line, said pins being arranged in a triangular configuration symmetrically about the longitudinal centre line of the earth pin, the transverse centre lines of the line and neutral pins being substantially aligned with the line and neutral pin centres spaced apart by 14 mm±0.2, the transverse centre line of the earth pin being displaced from the common centre line of the line and neutral pins by 4 mm±0.2, the said inlet being generally rectangular in profile, and having a key portion extending into the side of the inlet opposite to the earth pin.

From a fourth aspect, the invention provides a connector for an electrical appliance comprising three rectangular sockets constituting earth, line and neutral sockets for receiving earth, line and neutral pins provided in an appliance inlet, each said socket having longitudinal and transverse centre lines, said socket being arranged symmetrically in a triangular configuration about the longitudinal centre line of the earth connector, the line and neutral sockets sharing substantially a common transverse centre line and being spaced apart by 14 mm±0.2 and the transverse centre line of the earth socket being spaced 4 mm±0.2 mm therefrom, said connector being generally rectangular and having a keyway on its side opposite the earth socket.

A preferred embodiment of the invention will now be described by way of example with reference to the accompanying drawings in which:

FIGS. 1*a* and 1*b* extracts from sheet C16 of 320 IEC 1981 showing an appliance inlet and pin configuration;

FIGS. 2*a* and 2*b* are extracts from sheet C15 of 320 IEC 1981, showing a connector and socket configuration;

Figure 2A:
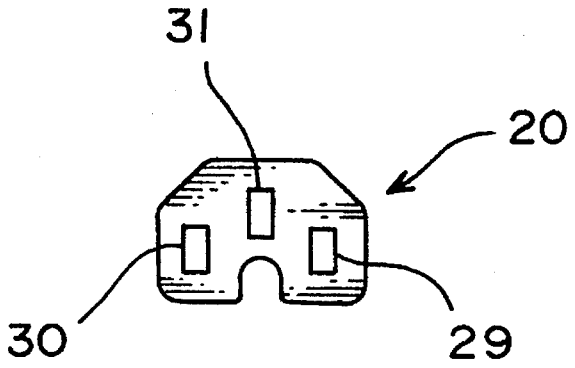
FIG. 2a (PRIOR ART)

With reference to FIGS. 1*a*, 1*b*, 2*a* and 2*b*, there are shown a standard connector and inlet of the kind described for use in a kettle or hot water jug, and in accordance with 320 IEC 1981.

In FIG. 1*a* and 1*b*, an appliance inlet 1 of the kind described comprises an inner profile 2. A generally arcuate key portion 3, extends upwardly from the base wall portion 4 of the inlet 2. The profile has side wall portions 5,6 blending smoothly into the base portion 4 and into chamfered portions 7,8. These portions 7,8, in turn blend into an upper wall portion 9. Within the inlet 2 are arranged three pins 10, 11, 12 whose dimensions and relative positions are determined by the dimensions (in millimeters) given in FIG. 1*a*. This is the pin configuration of the kind described as referred to herein. As applied to a hot water jug or kettle, the pins form part of a control of the appliance which comprises a 'dry boil' protector switch and a manually operable boiling control switch. The bottom left hand pin 11 is connected to the side of the control containing the "dry boil" switch, the bottom right hand pin 10 is connected to the side of the control containing the boiling switch, and the upper, central pin 12 is connected to the element of the appliance, for earthing purposes.

Figure 2B:
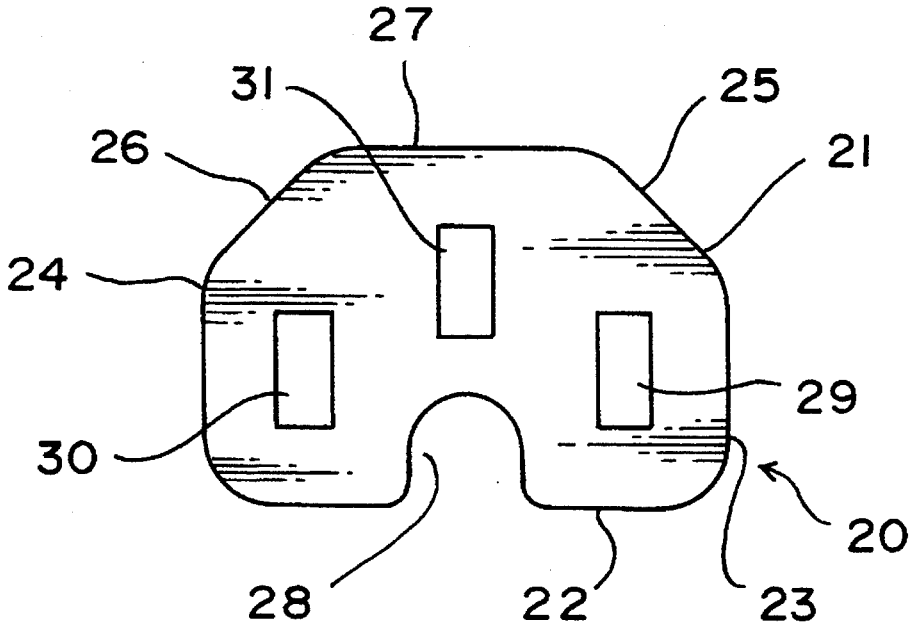
FIG. 2b (PRIOR ART)

Referring to FIGS. 2*a* and 2*b*, there is shown a connector 20 of the kind described in accordance with 320 IEC 1981. The connector has an outer surface 21 having a base portion 22, side portions 23, 24, chamfered portions 25, 26 and an upper portion 27. A generally arcuate keyway 28 is let into the base portion 22.

Arranged in the connector 20 are three sockets 29, 30, 31, whose dimensions and relative positions are determined by the dimensions (in millimeters) given in the Figures. Within the sockets 29, 30, 31 are arranged electrical connections (not shown). In accordance with 320 IEC 1981, the connections in the lower right socket 29 is connected to the line side of a supply, that in the lower left socket 30 with the neutral side of the supply and that in the central upper socket 31 with the earth of a supply. This is the socket configuration of the kind described as referred to herein.

It will be seen that the relative dimensions of the inlet 1 and connector 20 allow the latter to be inserted into the former. The keyway 28 in the connector 20 accommodates the key portion 3 of the inlet. The pins 10, 11, 12 enter the sockets 30, 29, 31 respectively to make electrical connection with the connections therein.

Thus, in the appliance as described above, the 'boil dry' switch is connected to the line side of the supply and the boiling switch to the neutral side of the supply.

Figure 3:
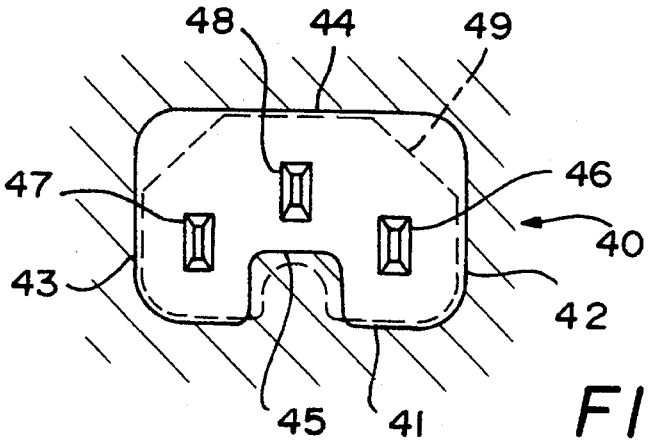
FIG. 3 is an end view of an inlet in accordance with the invention.

With reference to FIG. 3, an inlet 40 in accordance with the invention provided on a kettle or hot water jug is shown. The inner profile of the inlet comprises a base wall portion 41, side wall portions 42, 43 extending upwardly from, and blending with, the base wall portion 41, and a top wall portion 44 blending with the side portions 42, 43. A generally rectangular section key 45 is formed in the base portion 41. Terminal pins 46, 47, 48 of a control of the kettle or jug extend into the inlet, and are connected in the control in the same manner as described above.

The orientation of the pins, 46, 47, 48 and the general dimensions of the inlet are similar to the standard inlet 1 of the appliance described in FIG. 1. However, the profile of the inlet has changed. Specifically, the chamfered portions 7, 8 have been dispensed with and the key 45 modified. The inlet 40 measures 24 $mm_{-0}^{+0.5}$ by 16 $mm_{-0}^{+0.5}$ with radiused corners of 3 mm maximum radius. The section of the key 45 has been modified such that the keyway 28 of a standard connector 20 in accordance with 320 IEC 1981 cannot fit over it. This is shown schematically in FIG. 3 where the profile 49 of the connector 20 is shown in phantom lines as lying within the profile. Thus the inlet in accordance with the invention has exactly the same pin configuration as a standard inlet of the kind described i.e. it has a pin configuration of the kind described, but it differs from a standard inlet of the kind described as regards its profile. In the embodiment shown, the key 45 is 6.0 $mm_{-0.2}^{+0}$ wide, extending to a depth of 2.8 $mm_{-0}^{+0.2}$ from the inlet centre line.

Figure 5:
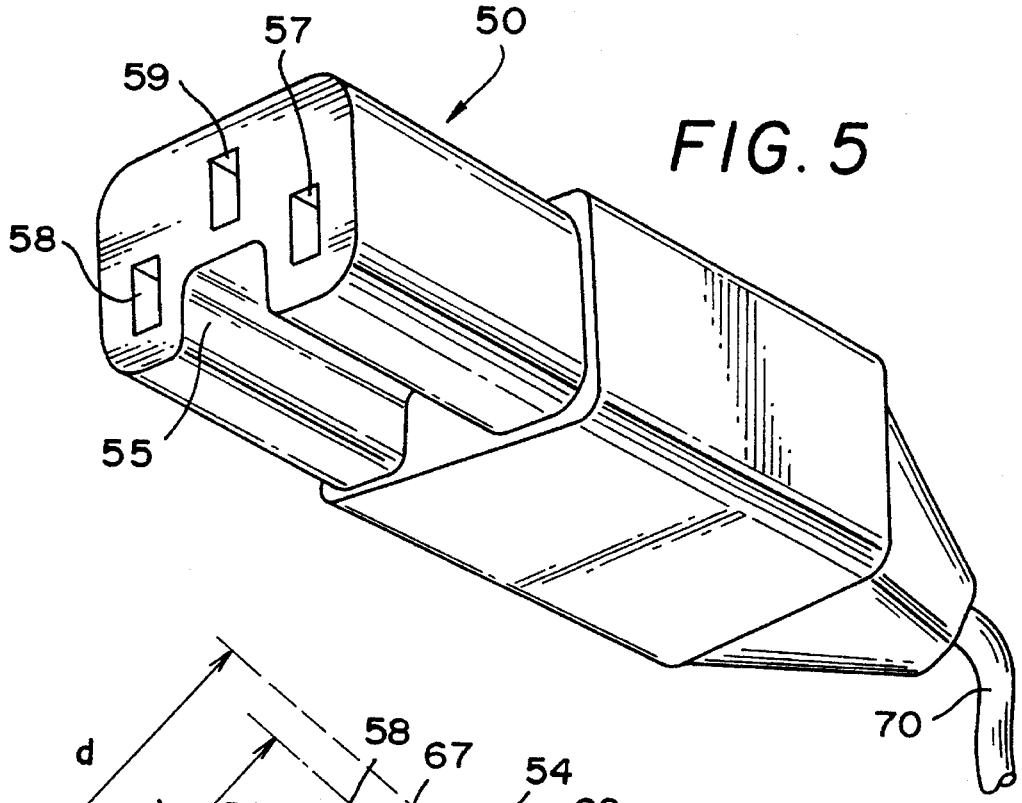
FIG. 5 is a perspective view of a connector in accordance with the invention.
Figure 4:
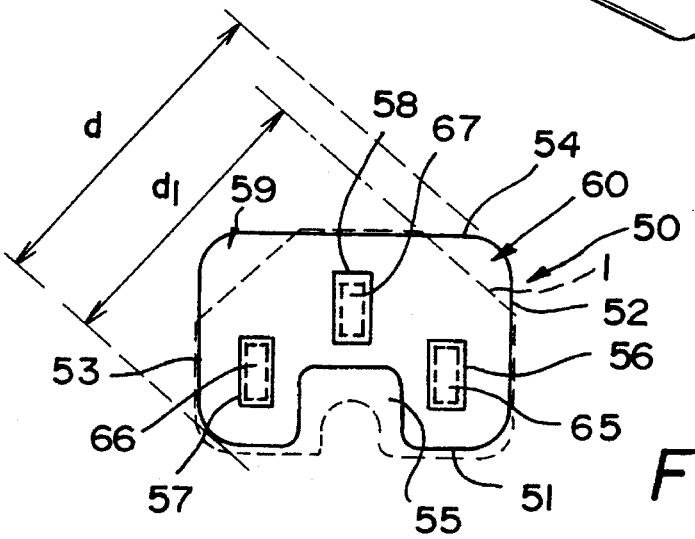
FIG. 4 is an end view of a connector in accordance with the invention showing the engagement face.

With reference to FIGS. 4 and 5 a connector 50 in accordance with the invention comprises an outer profile having a base portion 51, side portions 52, 53 extending upwardly from and blending with the base portion 51, and a top portion 54. A generally rectangular section keyway 55 is provided in the base portion 51. Sockets 56, 57, 68 are provided in the connector. Connections 65, 66, 67 provided within the respective sockets are connected with a supply through a lead 70 and a plug, not shown. However in contrast to the connector 20, the connection 65 provided in the lower right socket 56 is connected to the neutral side of the supply and the connection 66 in the lower left socket 57 is connected to the line side of the supply. Thus with respect to the connector 20, these connections have effectively reversed polarity and when the connector 50 is inserted in the inlet 40, the boiling switch of the control of the kettle or jug will effectively be connected to the line side of the supply, as required in the United States, and the boil dry switch connected to the neutral.

The general dimensions of the connector 50 and the orientation of the sockets 56, 57, 58 are similar to the standard connector 20, measuring 23 $mm_{-0.5}^{+0}$ by 15.8 $mm_{-0.5}^{+0}$ However, the profile of the connector has been modified to engage in the inlet 40 by changing the size and shape of the keyway 28. In this regard the keyway 28 is 6.05 $mm_{-0}^{+0.3}$ wide, extending to a depth of 2.7 $mm_{0.3}^{\pm 0}$ from the centre line of the connector.

To prevent a connector 50 of the invention being inserted in a standard inlet 1 in accordance with 320 TEC 1981, it will be noted that the chamfered portions 25, 26 of the connector 20 have been removed. As can be seen from FIG. 4, where the profile of a standard inlet 1 in accordance with 320 IEC 1981 is shown in phantom, upper corner portions 59, 60 extend beyond the chamfered portions 7, 8 of the inlet 1 to prevent insertion. Thus a diagonal dimension d of the connector 50 is greater than a corresponding dimension d1 of the standard inlet 1. Thus, it will be seen that the connector has a socket configuration of the kind described but differs from a standard socket connector of the kind described in its profile.

Thus it will be seen that an electrical coupling in accordance with the invention allows a standard pin arrangement to be maintained in an appliance, while reversing the polarity of the supply to the appliance. Furthermore, by modifying the standard coupling components, they will not be interchangeable or usable with standard coupling components.

It will be appreciated that other means of preventing interengagement of connectors of the kind described with inlets of the invention can be envisaged in addition to those described above. For example a location pin may project forwardly from the back of the inlet, parallel to the conductive pins, and a corresponding socket be provided on the connector of the invention. Similarly, to prevent engagement of a connector of the invention with an inlet of the kind described, the profile of the connector may change in any way such that it extends outside the profile of the inlet of the kind described.

I claim:

1. An electrical coupling in or for an electrical appliance such as a kettle or hot water jug comprising:

an inlet provided or adapted to be provided on said appliance and a connector provided or adapted to be provided on a power lead for mating engagement with said inlet, said inlet having pins arranged in a predetermined pin configuration with at least one of said pins providing a line connection and at least one of said pins providing a neutral connection, and said connector having sockets arranged in a predetermined socket configuration with at least one of said sockets providing a line connection and at least one said sockets providing a neutral connection, wherein:

a.) the polarity of electrical connections arranged within the sockets of the connector is reversed with respect to those in a standard connector such that the socket providing the line connection corresponds to the socket providing the neutral connection in the standard connector and the socket providing the neutral connection corresponds to the socket providing the line connection in the standard connector;

b.) first means are provided to prevent said connector being inserted into a standard inlet; and c.) second means are provided to prevent a standard connector being inserted into said inlet.

2. A coupling as claimed in claim 1 wherein said first means comprises a portion of the external profile of said connector extending outside a corresponding portion of the periphery of said standard inlet, so as to interfere therewith to prevent insertion of said connector into said standard inlet.

3. A coupling as claimed in claim 2 wherein said connector is generally rectangular in shape, having corner portions which extend beyond chamfered portions of the standard inlet.

4. A coupling as claimed in claim 1 wherein said second means comprises a portion of the periphery of said inlet which extends outside a corresponding portion of the periphery of the standard connector.

5. A coupling as claimed in claim 4 wherein said inlet has an inwardly projecting key in a position corresponding to a keyway of the standard inlet of the kind described and having a dimension which projects beyond the dimensions of said keyway such that the standard connector would not be able to enter said standard inlet.

6. A coupling as claimed in claim 5 wherein said connector has a keyway designed to accommodate said key of said inlet.

7. An inlet in or for an electrical appliance comprising three rectangular section pins constituting an earth pin, a neutral pin and a line pin, each pin having a longitudinal center line and transverse center line, said pins being arranged in a triangular configuration symmetrically about the longitudinal center line of the earth pin, the transverse center lines of the line and neutral pins being substantially aligned with the line and neutral pins centers spaced apart by approximately 14 mm, said inlet being generally rectangular in profile, and having a key portion extending into the side of the inlet opposite to the earth pin.

8. An inlet as claimed in claim 7 wherein each pin has a cross-section of approximately 4 mm by approximately 2 mm.

9. An inlet as claimed in claim 7 wherein said key is symmetrically arranged about the longitudinal center line of the earth pin.

10. An inlet as claimed in claim 7 wherein said key portion is generally rectangular in section.

11. An inlet as claimed in claim 10 wherein said key portion measures approximately 6.0 mm from the transverse center line of the inlet.

12. An inlet as claimed in claim 11 wherein said inlet measures approximately 24 mm by approximately 15 mm.

13. A connector for an electrical appliance comprising three rectangular sockets constituting earth, line and neutral sockets for receiving earth, line and neutral pins provided in an appliance inlet, each said socket having longitudinal and transverse center lines, said socket being arranged symmetrically in a triangular configuration about the longitudinal center line of the earth connector, the line and neutral sockets sharing substantially a common transverse center line and being spaced apart by approximately 14 mm and the transverse center line of the earth socket being spaced approximately 4 mm therefrom, said connector being generally rectangular and having a keyway on its side opposite the earth socket.

14. A connector as claimed in claim 13 wherein each socket has a cross sectional area of approximately 5 mm by approximately 2.5 mm.

15. A connector as claimed in claim 13 wherein said keyway is generally rectangular in section.

16. A connector as claimed in claim 13 wherein said keyway is approximately 6.05 mm wide and extends to a depth of approximately 2.7 mm from the center of said connector.

17. A connector as claimed in claim 13 which measures approximately 23 mm by approximately 15.8 mm.

18. An electrical coupling having an inlet and a connector for engagement therewith, said inlet comprising three pins constituting an earth pin, a neutral pin and a line pin, said pins each having a longitudinal center line and a transverse center line, said pins being arranged in a triangular configuration symmetrically about the longitudinal center line of the earth pin, the transverse center lines of the line and neutral pins being substantially aligned, with the pins spaced apart by approximately 14 mm, the transverse center line of the earth pin being displaced from the common center line of the line and neutral pins by approximately 4 mm, and said connector having three sockets constituting earth, line and neutral sockets for receiving the earth, line and neutral pins provided in the inlet, each said socket having longitudinal and transverse center lines, said socket being arranged symmetrically in a triangular configuration about the longitudinal center line of the earth connector, the line and neutral sockets sharing substantially a common transverse center line and spaced apart by approximately 14 mm and the transverse center line of the earth socket being spaced approximately 4 mm therefrom, said connector having a shape which is adapted to be received in said inlet to make electrical connection therewith, said inlet having first means such that a further connector having the same socket configuration as aforesaid, measuring 23 mm by approximately 15.8 mm, having chamfered corners at one side thereof extending at approximately 45° to the adjacent side walls to a distance of approximately 25 mm from the center line of the further connector and having a keyway portion symmetrically arranged on the side wall opposite the chamfers, said keyway portion being approximately 5 mm wide, extending to a depth of approximately 3.3 mm from the center line of the further connector, and being radiused at its bottom end, cannot be received therein, said electrical connector further having second means to prevent it being inserted in a further inlet having the same pin configuration as aforesaid, measuring 24 mm by approximately 16 mm having chamfered corners at an angle of approximately 45° to the shorter side walls and terminating approximately 3 mm from the center line of the further inlet and a key arranged symmetrically on the wall opposite the chamfers having a width of approximately 4.5 mm, extending to a depth of approximately 3.3 mm from the center line of the further socket and radiused at its bottom end.

19. A coupling as claimed in claim 18 wherein said second means is constituted in that said inlet has a key portion which is dimensioned to extend outside the keyway portion of said further connector, to prevent its use therewith.

20. A coupling as claimed in claim 18 or 19 wherein said first means is provided by said connector being generally rectangular so as to provide corner portions which would interfere with said chamfered portions of said further inlet to prevent its insertion therein.

21. A coupling as claimed in claim 20 wherein said inlet measures 24 mm and said key is generally rectangular, measuring approximately 6.0 mm wide and extending to a depth of approximately 2.8 mm from the center line of the inlet.

22. A coupling as claimed in claim 21 wherein said connector measures approximately 23 mm by approximately 15.8 mm and has a keyway in which said key engages, said keyway measuring approximately 6.05 mm wide and extending to a depth of approximately 2.7 mm from the center line of the connector.

23. A coupling as claimed in claim 1 or 18 wherein said pins are the terminal pins of a thermally sensitive control for an appliance.

* * * * *